US005575231A

United States Patent [19]

Metcalf

[11] Patent Number: 5,575,231

[45] Date of Patent: Nov. 19, 1996

[54] FLOTATION FOAM LINED PONTOON LOG

[75] Inventor: John P. Metcalf, Lebanon, Mo.

[73] Assignee: Outboard Marine Corporation, Waukegan, Ill.

[21] Appl. No.: 536,888

[22] Filed: Sep. 29, 1995

[51] Int. Cl.[6] ..... B63B 1/00

[52] U.S. Cl. ..... 114/61; 114/357

[58] Field of Search ..... 114/61, 292, 283, 114/356, 357, 123; 441/35, 44, 45

[56] References Cited

U.S. PATENT DOCUMENTS

| | | | |
|---|---|---|---|
| 4,046,091 | 9/1977 | Lomas, III et al. | 114/61 |
| 4,348,972 | 9/1982 | Parsons | 114/357 |
| 4,738,215 | 4/1988 | McMahon | 114/61 |
| 4,827,859 | 5/1989 | Powell | 114/357 |
| 5,259,330 | 11/1993 | Faulkner | 114/61 |

*Primary Examiner*—Stephen Avila
*Attorney, Agent, or Firm*—Jack D. Nimz

[57] ABSTRACT

A foam lined pontoon log in which polyurethane flotation foam is sprayed onto the interior surfaces of the pontoon log and adheres to the interior surfaces of the pontoon log. The flotation foam is built up to a desired thickness, but does not completely fill the interior of the pontoon log. The foam lining of the pontoon log interior surface provides the pontoon log with improved resistance to water leakage through the outer shell of the log, improved structural rigidity, and improved sound dampening. The pontoon log may have a nose cone section at its bow end with splash guard plates. The interior of the nose cone section is filled with flotation foam to a height above the splash guard plates to prevent water ingress associated with pin-sized holes resulting from welding of the splash guard plates to the pontoon log body.

7 Claims, 2 Drawing Sheets

FLOTATION FOAM LINED PONTOON LOG

FIELD OF THE INVENTION

The present invention pertains to pontoon boats, and more particularly, pertains to pontoon logs for providing flotation support of pontoon boats.

BACKGROUND OF THE INVENTION

Pontoon boats, using pairs of pontoon logs as flotation devices for supporting the deck of a pontoon boat, are a popular recreational water item. The deck of a pontoon boat is typically large enough to accommodate several people simultaneously during travel of the pontoon boat across a body of water.

Traditionally, pontoon logs used to support a pontoon boat deck were a generally hollow enclosure, with the air entrapped in the hollow enclosure providing the requisite buoyancy to maintain the boat afloat. The hollow enclosure is typically formed of a thin sheet of metal. To provide increased structural integrity to the thin sheet of metal forming the hollow enclosure, billets of polystyrene foam have been inserted into the hollow enclosure in a T-shaped configuration, extending the length of the pontoon log.

While the billets of polystyrene foam are buoyant and therefore provide some degree of flotation in the event of a puncture of the metal forming the hollow enclosure of the pontoon logs, the polystyrene billets do not prevent water from flooding the log interior through the puncture opening. The flooding of the interior of the pontoon log displaces the air therein and thereby significantly reduces the buoyancy of the pontoon log.

Accordingly, there is a need for a pontoon log having a structural support for its interior which prevents the influx of water into the pontoon log in the event it is punctured. This is desired to assure that the pontoon boat remains steadily afloat in the event of a puncture to one of its pontoon logs.

U.S. Pat. No. 4,777,898 discloses a pontoon log in which the entire interior of the pontoon log is completely filled in with flotation foam. While this construction provides the desired protection against influx of water into the pontoon log interior in the event of a puncture, this construction suffers several shortcomings. Principally, the quantity of flotation foam required to completely fill the pontoon log interior adds considerable expense to the pontoon logs. Additionally, the large volume of foam required to completely fill the pontoon log interior adds considerable undesirable weight.

There is a need for a pontoon log having the ability to withstand a puncture to its shell without resulting in flooding of the pontoon log interior which is less expensive and lighter in weight than pontoon logs having their entire interior filled with flotation foam.

Still further, there is a need for such a pontoon log which also lends itself to welding of a top cover to seal the top of a pontoon log without affecting the watertight integrity of the pontoon log.

SUMMARY OF THE INVENTION

In accordance with the present invention, a pontoon log is provided in which a layer of flotation foam is applied to the interior surface of the shell of the pontoon log. The layer of flotation foam does not completely fill in the main body portion of the pontoon log, but rather is of a generally uniform thickness inwardly from the pontoon log wall.

The layer of flotation foam is built up to the desired thickness, with the initial application of foam adhering to the interior wall of the pontoon log and subsequently applied foam adhering to the previously-applied foam. Since, in accordance with the present invention, the foam all adheres directly to the interior surface of the pontoon log, the flotation foam serves as a sealant to prevent leakage of water into the pontoon log interior in the event of a rupture of the pontoon log. The layer of flotation foam also provides the desired added structural integrity or stiffening of the pontoon log. In accordance with the pontoon log structure of the present invention, these advantageous characteristics are provided in a pontoon log which is considerably less expensive and which weighs less than prior pontoon logs.

The pontoon log of the present invention lends itself to use with any of a wide variety of differently-shaped pontoon logs. In the preferred embodiment of the invention, the pontoon log is generally U-shaped, having an open upper end. The open upper end of the pontoon log is sealed by welding a top cover sheet over the open upper end of the pontoon log. The upper end of the sealed pontoon log has a flange which is fastened to structural members on the underside of a deck to form the completed pontoon boat, such as by bolting the flange of the pontoon log to the underside of a deck. In this illustrative and preferred embodiment, the flotation foam terminates approximately two inches from the upper end of the U-shaped shell. Thereby, the flotation foam is not exposed to the heat associated with welding of the top cover to the pontoon log. Also, with pontoon logs of the type having a splash guard, the flotation foam is applied to the pontoon log interior to a height above the splash guard, whereby the flotation foam blocks the entry of water into the pontoon log interior in the event of pinholes created during welding of the splash guard to the pontoon log body.

DETAILED DESCRIPTION OF PREFERRED EMBODIMENTS

Figures 1, 2, 3:
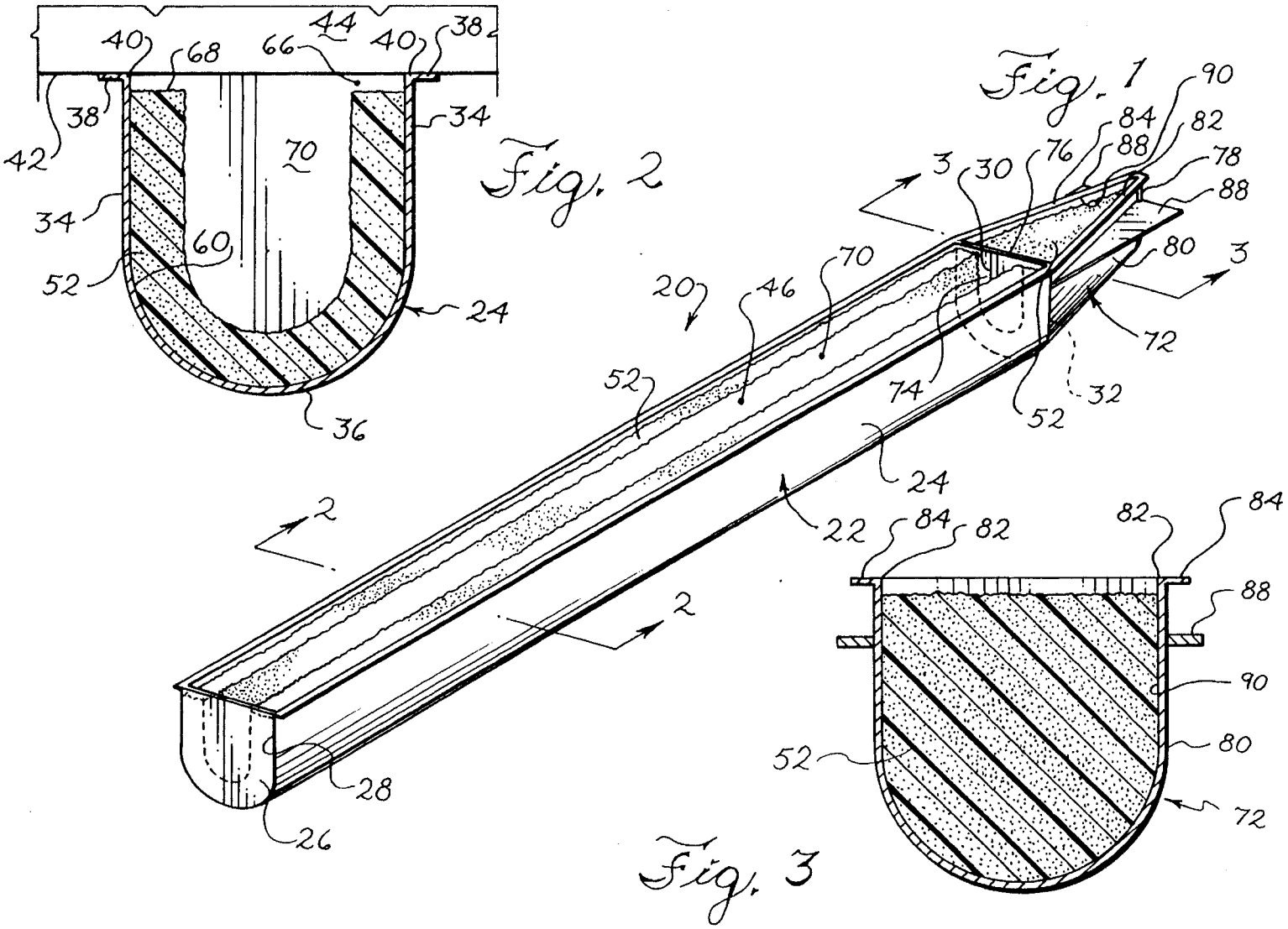
FIG. 1 is a perspective view of a pontoon log embodying various features of the present invention.
FIG. 2 is a sectional view of the main body portion of the pontoon log of FIG. 1, taken along line 2—2 of FIG. 1.
FIG. 3 is a sectional view of the nose cone portion of the pontoon log of FIG. 1, taken along line 3—3 of FIG. 1.

A pontoon log embodying various features of the present invention is illustrated in FIGS. 1–3 and referred to generally by reference numeral 20. The illustrated pontoon log is of U-shaped configuration, however it will be readily appreciated that the invention is in no way limited to such U-shaped logs, but rather lends itself to use with a wide variety of pontoon log configurations including, but not limited to, cylindrically shaped logs.

As best seen in FIG. 1, the illustrated pontoon log comprises an elongated main body portion 22 having a shell 24 of U-shaped cross section, as shown in FIG. 2. A generally flat rear plate 26 is sealingly engaged to the stem end 28 of the shell 24 of the main body portion 22 of the pontoon log, such as by welding. A generally flat front plate 30 is sealingly engaged to the stern end 32 of the shell 24 of the main body portion 22. With reference now to FIG. 2, the U-shaped shell 24 of the main body portion 22 is defined by a pair of generally parallel upstanding vertical wall portions 34 interconnected by an arcuate lower portion 36. Integral flanges 38 are formed at the upper ends 40 of the vertical wall portion 34 extending generally perpendicularly outwardly from their respective vertical wall portions 34. Holes are formed in the flange through which bolts are received, with the bolts being threadably engageable with structural members on the underside of the boat deck for securing of the pontoon logs 20 to the underside 42 of the deck of a boat 44. Accordingly, as best seen with reference to FIG. 1, the shell 24 and the forward and rear plates 26 and 30 define an open-ended interior space 46, with the upper end of the space subsequently being covered by welding of a top cover sheet across the open top of the pontoon log. Thereafter, the completed pontoon log is attached to the underside of the boat deck 44.

Figures 4, 5:
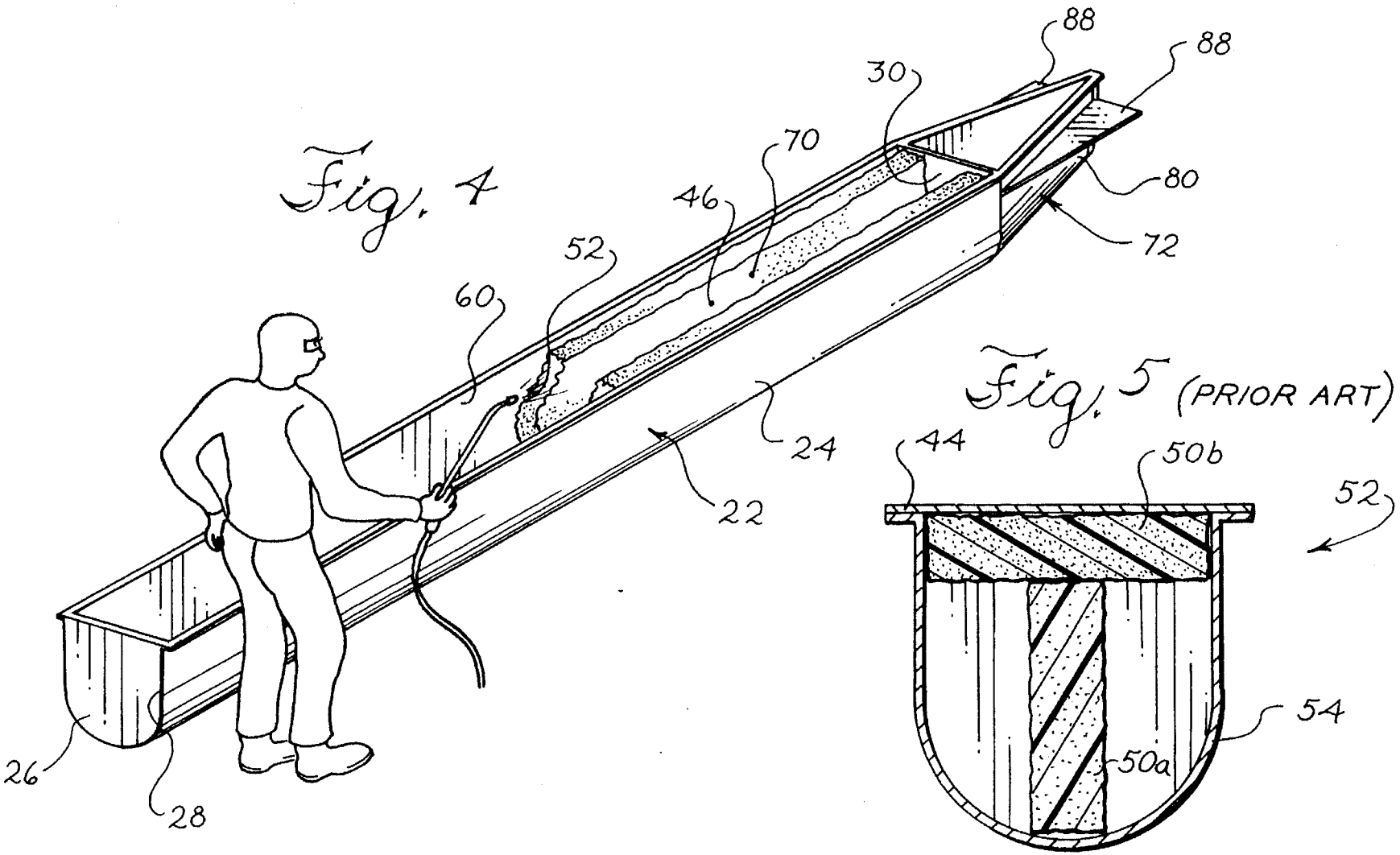
Fig. 5 (PRIOR ART)
FIG. 4 is a perspective view of a process for forming the pontoon log of FIG. 1.
FIG. 5 is a sectional view taken through the main body portion of a prior art pontoon log, illustrating the styrene billets used in the prior art.

In the prior art, as illustrated in FIG. 5, preformed styrene billets 50 were mounted in the interior of the pontoon log 52. Typically, the styrene billets 50 were arranged with a vertical billet **50*a* centered within the shell 54 of the log 52 and extending the length of the log, with a horizontal billet 50*b* disposed at the upper end of the vertical billet and extending the length of the main body portion 22 of the log 20 along its upper end. As will be appreciated by viewing the prior art pontoon log 52 of FIG. 5, a leak in the shell 54 at virtually any point below the horizontal billet 50*b*** may result in undesirable leakage into the interior of the pontoon log.

In accordance with the present invention, flotation foam 52, such as polyurethane foam, is applied to the interior surface 60 of the shell 24 of the main body portion 22 and built up to a generally uniform thickness inwardly of the shell 24. The flotation foam 52 is preferably applied by spraying such as with a spraying gun 62, such as a Gussimer gun or any other suitable spraying device. Prior to welding of the top cover sheet to the pontoon log 20, i.e. while the top of the log 20 remain open, flotation foam 52 is sprayed into the interior of the log as illustrated in FIG. 4. The flotation foam 52 is applied to the interior surface 60 of the shell 24 from the bottom of the arcuate lower portion 36 of the shell 24 to a height a short distance from the upper ends 40 of the vertical wall portions 34, and built up to any desired thickness. A short space 66 is left between the upper end 68 of the flotation foam 52 and the upper ends 40 of the vertical wall portions 34 of the shell 24 from which the flanges 38 extend so that the flotation foam 52 is sufficiently spaced from the heat associated with welding of the top cover sheet to the pontoon log 20. Manifestly, the flotation foam 52 may be applied up to any level, and the invention is not limited to pontoon logs in which the flotation foam terminates a short distance from the upper end of the shell.

In other prior art pontoon logs in which flotation foam was sprayed into the interior of the log, the flotation foam completely filled the interior region of the pontoon log. Contrarily, considerable savings in weight and cost are realized with the pontoon log 20 of the present invention in which the flotation foam 52 does not completely fill the interior region 46 of the shell 24, but rather is applied to the interior surface 60 of the shell 24 in a generally uniform thickness which is sufficiently thin to leave a hollow interior region 70 inwardly of the inner surface 60 of the shell 24 following application of the flotation foam. The flotation foam 52 may be built up from the lower, arcuate end of the shell on upwardly by first applying the flotation foam 52 to the bottom of the shell along the length of the shell from its bow end 32 to its stern end 26 and then building upwardly from this applied foam. Alternatively, the flotation foam 52 may be built up to a desired thickness at the bow end 32 of the log 20 with this thickness of foam being applied all the way back to the stern end 28 of the shell 24, as illustrated in FIG. 4. Of course, the application of the flotation foam need not proceed from the bow end to the stern end, but may proceed from the stern end to the bow end as well. Any spraying pattern may be employed which will provide the desired generally uniform thickness of flotation foam 52.

The adherence of the flotation foam 52 to the inner surface 60 of the shell 24 and building up of the foam onto itself forms a leak resistant seal about the inner surface 60 of the shell 24. Accordingly, the flotation foam 52 blocks the ingress of water into the interior 46 of the log 20 in the event of a leak in the shell 24. That is, with the structure of the pontoon log 20 of the present invention, the flotation foam 52 provides a barrier to leakage of water into the log both for punctures through the shell prior to use of the logs and for holes in the shell 24 which may occur during or after use of the pontoon log 20. Once the flotation foam 52 has cured or hardened, the flotation foam 52 provides structural support, primarily along the longitudinal axis of the log 20.

In the illustrated pontoon log 20, integral with the bow end 32 of the shell 24 is a nose cone portion 72 of the pontoon log 20; whereby, on the stern side 74 of the front plate 30 is disposed the main body portion 22 of the pontoon log 20, and on the bow side 76 of the front plate 30 is disposed the nose cone portion 72 of the pontoon log 20. Accordingly, the front plage 30 provides a barrier between the interior volume of the nose cone portion 72 and the interior volume of the main body portion 22.

The nose cone portion 72 is generally triangular shaped as defined by nose shell 80 and tapers from the forward plate 30 toward the pointed bow end 78 of the nose cone portion 72. At the upper end 82 of the nose shell 80 is an integral nose flange 84 which extends substantially perpendicularly outwardly from the upper end 82 of the nose shell 80. The nose flange 84 of the nose section 72 extends substantially continuous with the flanges 38 of the main body section 24, allowing for a continuous weld about the periphery of the upper end of the pontoon log 20 to secure the pontoon log 20 to the boat deck 44.

Splash guard plates, such as the triangular splash guard plates 88 illustrated in FIG. 1, may be secured to the nose shell 80 to extend substantially horizontally during navigation of the pontoon log 20. A problem frequently encountered during welding of the splash guard plates 88 to the nose shell 80 is the propensity for developing pin-sized holes in the nose shell 80 as a result of welding. This problem is overcome by the present invention in which the flotation foam 52 is applied to the interior surface 90 of the nose shell 80 to a level higher than the level of the splash guard plates 88. Thereby, due to the sealant properties of the flotation foam applied in accordance with the present invention as discussed above, the presence of small holes in the nose shell 80 associated with welding of the splash guard plates 88 does not present a leakage problem. That is, the flotation foam lining of the interior surface 90 of the nose shell 80 seals any holes which were present due to welding of the splash guard plates 88 to the nose shell 80.

It is also desirable to provide the nose cone section 72 with impact resistance sufficient to withstand a direct impact in the event the pontoon log runs into something. In this regard, it is preferred that the interior of the nose cone portion 72 be filled in completely up to a level higher than the splash guard plates 88, rather than having a generally uniform thickness applied to the interior surface 90 of the nose shell 80 as desired for the main body section 22 of the pontoon log 20. This structure is illustrated in FIG. 3.

Accordingly, as best seen in FIG. 1, other than a short space or gap remaining adjacent the upper end of the pontoon log 20, essentially the entire interior surface of the pontoon log, including both the interior surface 60 of the shell 24 of the main body section 22 and the interior surface 90 of the nose shell 80 of the nose cone section 72 has flotation foam 52 adhered thereto. The adherence of flotation foam 52 to such a substantial portion of the interior surfaces 60 and 90 of the pontoon log 20 provides considerably improved deadening of sound associated with water splash against the exterior of the pontoon log as compared to the sound level realized with employment of preformed polystyrene foam billets as in the prior art.

While other flotation foams may be employed, polyurethane foam is preferred due to its dent and puncture resistance, positive flotation, and structural soundness, and cost. The flotation foam lining of the interior surface 60 of the main body portion 22 of the shell 24 provides significant structural support allowing for the shell 24 to be formed of thinner gauge metal than would otherwise be suitable. As the shell 24 is typically made of aluminum, the reduction in thickness of the shell may provide a very significant cost savings over prior art shells.

By way of illustrative example only, good results have been obtained with a generally uniform thickness of polyurethane foam of approximately two inches, with the foam terminating approximately two inches from the upper end of the log.

The method of the present invention presents an inexpensive means for manufacturing pontoon logs. One alternative method which may be employed is to flock or spin polyurethane foam inside of a log body which has already been secured to the underside of a boat deck 44, whereby the foam is applied along the length of the log body, with the spinning throwing the foam against the interior surface of the log body. By controlling the rate of foam supplied to the spinning tool and the rate of advancement of the spinning tool through the pontoon log interior, the foam may be built up to any desired thickness. While the present invention is described herein by way of illustrative and preferred embodiments, the present invention is not limited to the specific embodiments set forth herein, and it will be readily apparent to those skilled in the art that numerous modifications and variations can be made thereto without departing from the essence and scope of the invention as forth in the accompanying claims. For instance, while the invention is described in connection with an embodiment in which the flotation foam 52 extends completely from the bow end 32 of the shell 24 to the stern end 28 of the shell 24, other foam configurations may be employed; however it is preferred that in such alternative arrangements the flotation foam extend over at least a substantial portion of the inner surface of the shell between the bow and stern ends of the shell.

What is claimed is:

1. A pontoon log, comprising:

a shell having a bow end and a stern end, and having an outer surface and an inner surface defining an interior shell volume;

a lining of flotation foam adhered to, and extending over at least a substantial portion of, the inner surface of the shell between said bow end and said stern end of the shell; and the foam lining being sufficiently thin to leave an inner free surface of said foam lining which inner free surface is not bound or constrained by any other surface, with the portion of the interior shell volume which is disposed interiorly of the inner free surface of the foam being hollow.

2. A pontoon log in accordance with claim 1 in which the outer shell further comprises a nose cone section at said bow end.

3. A pontoon log in accordance with claim 2 in which the nose cone section has an upper end and a lower end and has a splash deflector, with the nose cone section being filled with flotation foam from its lower end to a height above the splash deflector.

4. A pontoon log in accordance with claim 3 in which the nose cone section defines an internal volume and in which the nose cone section is filled with said flotation foam over approximately the lower sixty percent of its internal volume.

5. A pontoon log in accordance with claim 1 in which the shell is generally U-shaped and defines flanges at its upper end for attachment to a pontoon boat.

6. A pontoon log in accordance with claim 5 in which the lining of flotation foam terminates a predetermined distance from said shell upper end to facilitate attachment of the pontoon log to the pontoon boat.

7. A pontoon boat for supporting one or more boaters while traveling in water, the pontoon boat comprising:

a deck for supporting said one or more boaters;

at least one pontoon log for flotation support of the deck;

said at least one pontoon log comprising a shell having a bow end and a stern end, and having an outer surface and an inner surface defining an interior shell volume, a lining of flotation foam adhered to, and extending over at least a substantial portion of, the inner surface of the shell between said bow end and said stern end of the shell, and the foam lining being sufficiently thin to leave an inner free surface of said foam which inner free surface is not bound or constrained by any other surface or material and is not adhered to any other surface, with the portion of the interior shell volume which is disposed interiorly of the inner free surface of the foam being hollow.

* * * * *